US010066519B2

(12) United States Patent
Camilo et al.

(10) Patent No.: US 10,066,519 B2
(45) Date of Patent: Sep. 4, 2018

(54) LOCKING CLEARANCE SETTING DEVICE FOR CAMSHAFT PHASER

(71) Applicant: Schaeffler Technologies AG & Co. KG, Herzogenaurach (DE)

(72) Inventors: Alexandre Camilo, Rochester Hills, MI (US); Renato de Oliveira Ghiraldi, Sterling Heights, MI (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 128 days.

(21) Appl. No.: 15/341,561

(22) Filed: Nov. 2, 2016

(65) Prior Publication Data

US 2018/0119580 A1 May 3, 2018

(51) Int. Cl.

| | |
|---|---|
| ***F01L 1/46*** | (2006.01) |
| ***F01L 1/344*** | (2006.01) |
| *F01L 1/047* | (2006.01) |

(52) U.S. Cl.

CPC ..... *F01L 1/344* (2013.01); *F01L 1/46* (2013.01); *F01L 1/047* (2013.01); *F01L 2001/34469* (2013.01); *F01L 2103/02* (2013.01)

(58) Field of Classification Search

CPC ... F01L 2001/34453; F01L 2001/34469; F01L 1/46; F01L 2103/02

USPC ..... 123/90.15, 90.17

See application file for complete search history.

(56) References Cited

U.S. PATENT DOCUMENTS

| | | | |
|---|---|---|---|
| 6,948,467 | B2 | 9/2005 | Lipke et al. |
| 7,318,400 | B2 | 1/2008 | Lipke et al. |
| 8,640,334 | B2 | 2/2014 | Vukovich et al. |
| 2009/0266322 | A1 | 10/2009 | Fischer |
| 2013/0092112 | A1 | 4/2013 | Watanabe |
| 2013/0180481 | A1 | 7/2013 | Kato et al. |
| 2013/0228142 | A1 | 9/2013 | Kobayashi et al. |

FOREIGN PATENT DOCUMENTS

| | | | |
|---|---|---|---|
| WO | 2015/193298 | A1 | 12/2015 |

*Primary Examiner* — Jorge Leon, Jr.

(74) *Attorney, Agent, or Firm* — Volpe & Koenig, P.C.

(57) ABSTRACT

A camshaft phaser including a locking clearance setting pin is provided. The camshaft phaser includes a stator including a first plurality of pin holes extending axially in at least one of the radially inwardly extending lobes arranged along an arcuate path. A locking cover engages against a first axial end face of the stator and includes a locking pin bore and a second plurality of pin holes arranged along the arcuate path and angularly spaced apart from one another by a different angular spacing than the first plurality of pin holes. A pin extends through a respective one of the first plurality of pin holes and a corresponding one of the second plurality of pin holes, such that a location of the pin sets an angular adjustment of the locking pin bore relative to the stator.

12 Claims, 13 Drawing Sheets

LOCKING CLEARANCE SETTING DEVICE FOR CAMSHAFT PHASER

FIELD OF INVENTION

The present invention relates to a camshaft phaser, and is more particularly related to an arrangement for setting a locking clearance for a camshaft phaser.

BACKGROUND

Camshaft phase adjustment assemblies are used to vary the phase angle relationship between a crankshaft and a camshaft. Camshaft phasers are generally assembled using a plurality of bolts to retain a locking cover to a sealing cover, with a stator and a rotor arranged between the locking cover and the sealing cover. These bolts must be strong enough to reliably hold together the components of the camshaft phaser during operation. Since failure of these bolts renders the camshaft phaser inoperable, it is extremely important to use high strength bolts, which can be expensive.

Camshaft phasers also include a locking assembly to control rotational locking of the rotor and the stator. The locking assembly includes a locking pin that slidably engages with a locking pin bore in a locking cover. Due to manufacturing tolerances and imprecise angular alignment, the locking pin can cause undesirable noise as it moves into engagement with the locking pin bore.

It would be desirable to provide an improved camshaft phaser that simultaneously reduces the load on the bolts as well as reduces or eliminates noise generated by the locking assembly due to inadequate locking clearance.

SUMMARY

A camshaft phaser including a locking clearance setting pin is provided. The camshaft phaser includes a stator including an outer circumferential wall with radially inwardly extending lobes circumferentially spaced apart from each other. The stator includes at least one first bolt hole extending axially through at least one of the radially inwardly extending lobes and a first plurality of pin holes extending axially in at least one of the radially inwardly extending lobes arranged along an arcuate path. A rotor is arranged within the stator and includes radially outwardly extending vanes. Each of the vanes is arranged between an adjacent pair of the radially inwardly extending lobes of the stator to define an advance chamber and a retard chamber on opposite sides of each of the vanes between the stator and the rotor. A movable locking pin is arranged in the rotor. A locking cover engages against a first axial end face of the stator. The locking cover includes a locking pin bore that is adapted to receive the locking pin, at least one second bolt hole, and a second plurality of pin holes arranged along the arcuate path and are angularly spaced apart from one another by a different angular spacing than the first plurality of pin holes. A sealing cover engages against a second axial end face of the stator, and the sealing cover includes at least one third bolt hole. At least one bolt extends through the at least one first bolt hole of the stator, the at least one second bolt hole of the locking cover, and the at least one third bolt hole of the sealing cover. A pin extends through a respective one of the first plurality of pin holes and one of the second plurality of pin holes, such that a location of the pin is used for an angular adjustment of the locking pin bore relative to the stator. Use of the pin for angular adjustment of the locking pin bore both reduces the noise generated by an associated locking mechanism and diminishes the load on the bolt.

A method for setting a locking clearance of a camshaft phaser is also provided. The method includes providing a camshaft phaser including a stator having an outer circumferential wall with radially inwardly extending lobes circumferentially spaced apart from each other, at least one first bolt hole extending axially through at least one of the radially inwardly extending lobes, and a first plurality of pin holes extending axially in at least one of the radially inwardly extending lobes arranged along an arcuate path. A rotor is arranged within the stator including radially outwardly extending vanes, and each of the vanes being arranged between an adjacent pair of the radially inwardly extending lobes of the stator to define an advance chamber and a retard chamber on opposite sides of each of the vanes between the stator and the rotor. The rotor includes a movable locking pin. A locking cover is engaged against a first axial end face of the stator. The locking cover includes a locking pin bore that is adapted to receive the locking pin, at least one second bolt hole, and a second plurality of pin holes arranged along the arcuate path and angularly spaced apart from one another by a different angular spacing than the first plurality of pin holes. A sealing cover is engaged against a second axial end face of the stator. The sealing cover includes at least one third bolt hole and at least one bolt extends through the at least one first bolt hole of the stator, the at least one second bolt hole of the locking cover, and the at least one third bolt hole of the sealing cover. The camshaft phaser includes at least one pin. The method includes inserting the at least one pin through a respective one of the first plurality of pin holes and a corresponding one of the second plurality of pin holes. The method also includes setting an angular adjustment of the locking pin bore relative to the stator by positioning the at least one pin within the respective one of the first plurality of pin holes and the corresponding one of the second plurality of pin holes.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENTS

Figure 1:
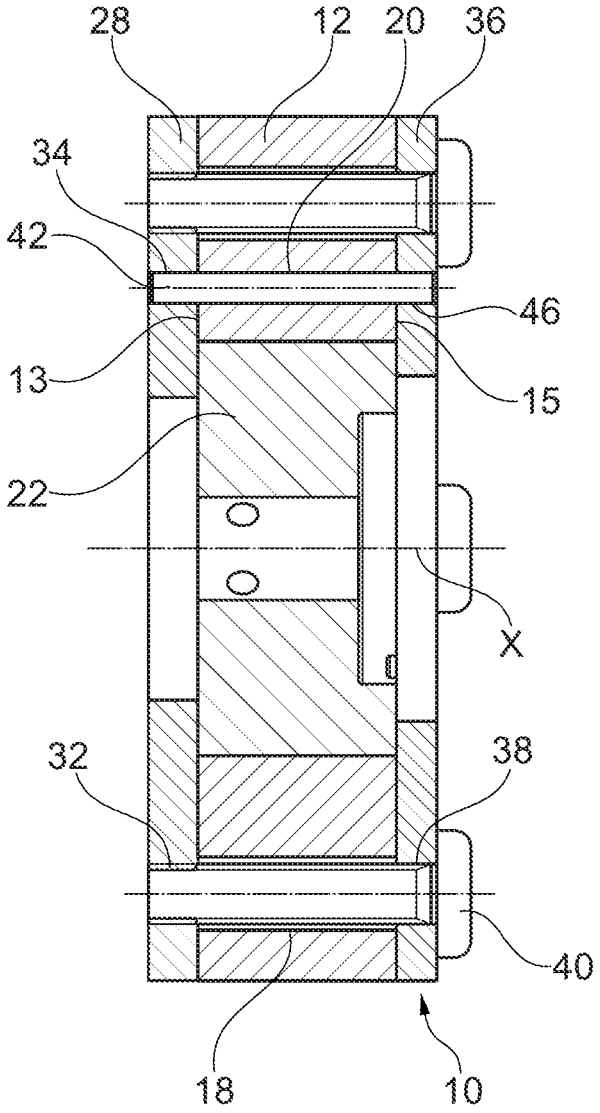
FIG. 1 is a cross sectional view of a camshaft phaser according to a first embodiment.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. "Axially" refers to a direction along the axis of a shaft. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

Figure 2:
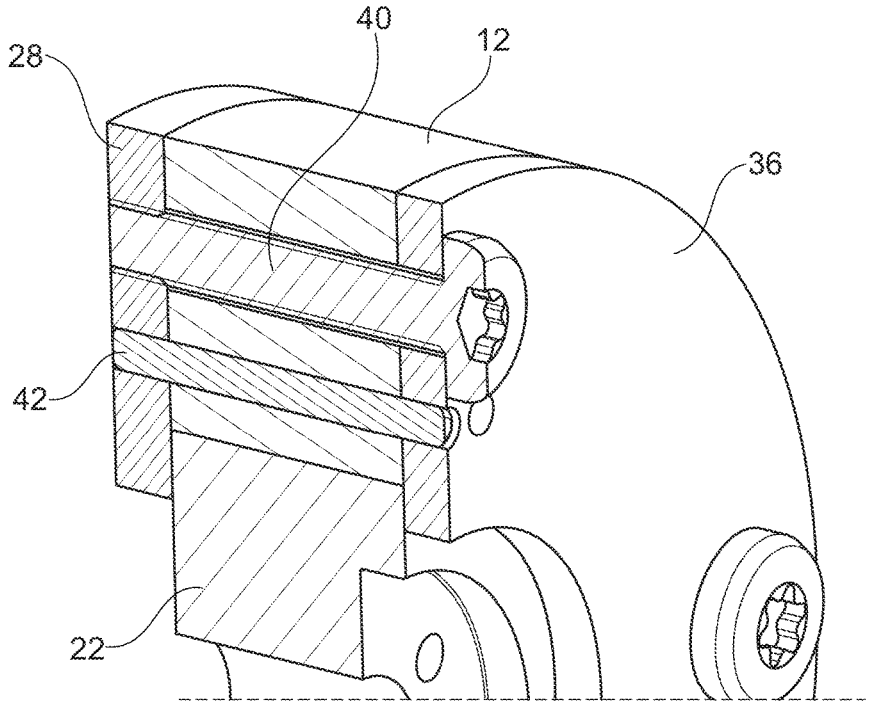
FIG. 2 is a magnified view of a cross section of the camshaft phaser of FIG. 1.
Figure 3:
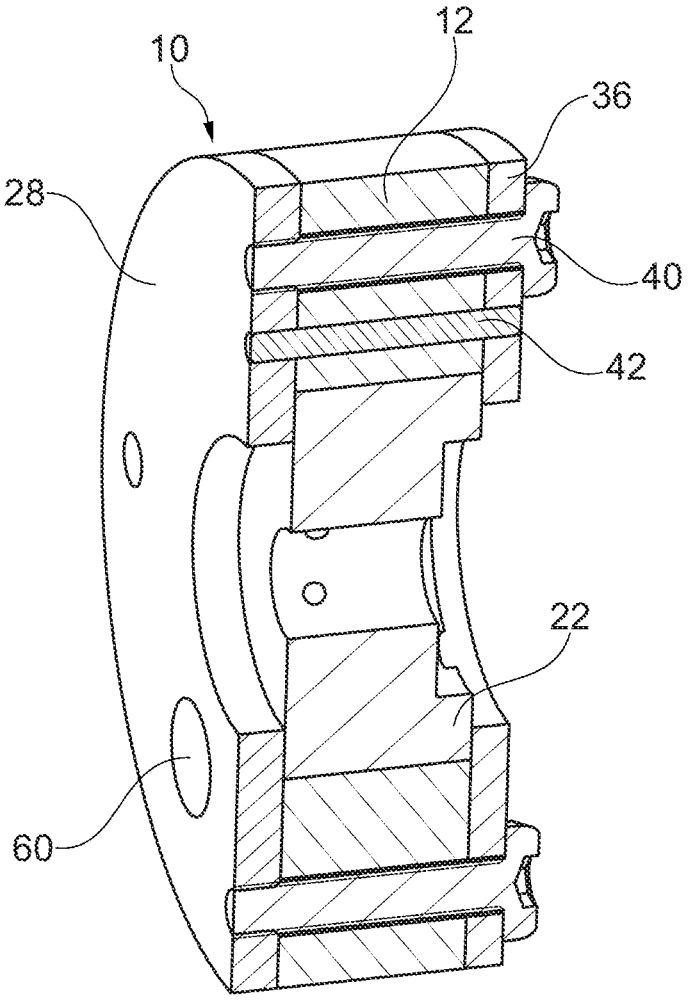
FIG. 3 is a perspective view of a cross section of the camshaft phaser of FIGS. 1 and 2.

Referring to FIGS. 1-3, a first embodiment of a camshaft phaser 10 is illustrated. The camshaft phaser 10 includes a stator 12 (illustrated separately in FIG. 4) including an outer circumferential wall 14 with radially inwardly extending lobes 16 circumferentially spaced apart from each other. The stator 12 includes at least one, and preferably a plurality of first bolt holes 18 extending axially through at least one, and preferably a plurality of the radially inwardly extending lobes 16, and a first plurality of pin holes 20 extending axially in at least one of the radially inwardly extending lobes 16 arranged along a first arcuate path (P1). In the first embodiment, the first plurality of pin holes 20 extend between the axial end faces 13, 15 of the stator 12. In a second embodiment, shown in FIG. 9, the first plurality of pin holes 20' of the stator 12' are blind holes.

A rotor 22 is arranged within the stator 12 and includes radially outwardly extending vanes (not illustrated in the drawings). Exemplary camshaft phase adjustment assemblies are shown in U.S. Pat. Nos. 7,318,400 and 6,948,467, both of which are incorporated by reference, which illustrate known configurations of rotors and stators. Each of the vanes of the rotor 22 is arranged between an adjacent pair of the radially inwardly extending lobes 16 of the stator 12 to define an advance chamber and a retard chamber on opposite sides of each of the vanes between the stator 12 and the rotor 22.

Figure 5:
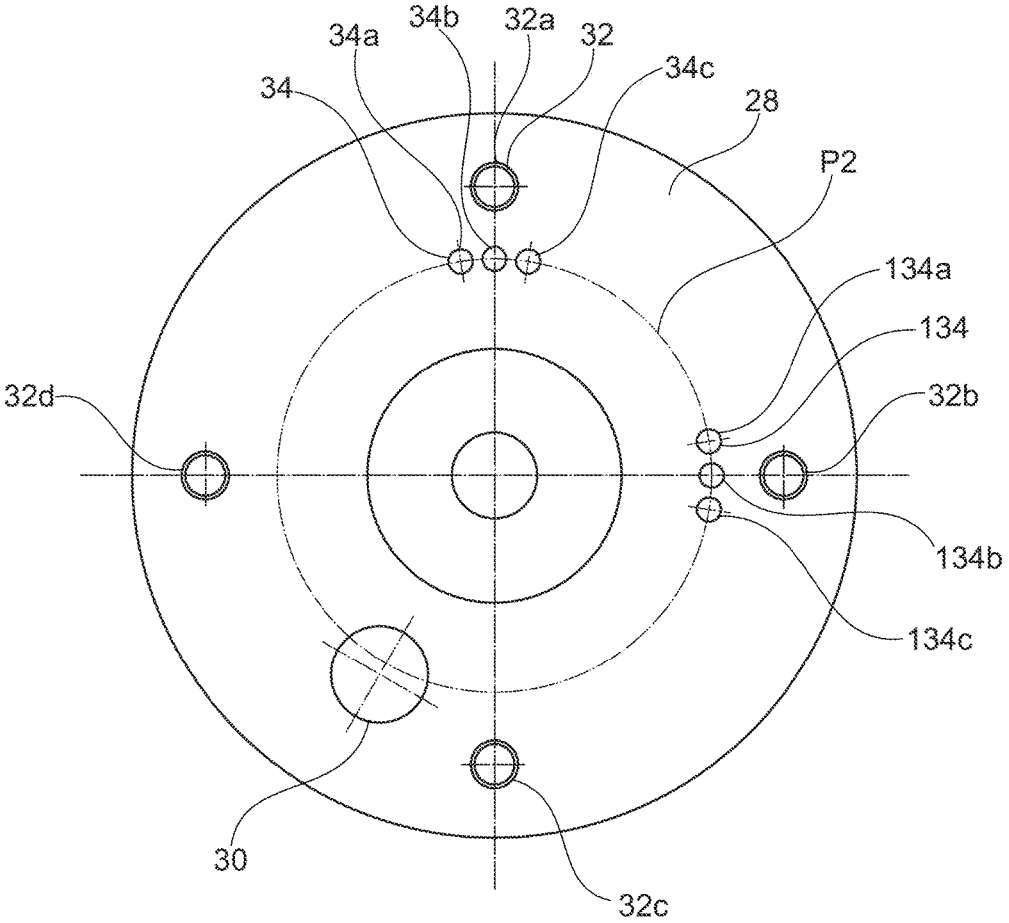
FIG. 5 is a front view of a locking cover for the camshaft phaser of FIGS. 1-3.

A locking cover 28, shown separately in FIG. 5, engages against a first axial end face 13 of the stator 12. The locking cover 28 includes a locking pin bore 30, at least one, and preferably a plurality of second bolt holes 32, and a second plurality of pin holes 34. The locking pin bore 30 is dimensioned to receive a locking pin of a locking assembly 60. The internal features of the locking assembly 60 are not illustrated in the drawings, but are understood by those of ordinary skill in the art and are fully shown and described in U.S. Pat. Nos. 7,318,400 and 6,948,467. The second plurality of pin holes 34 are arranged along a second arcuate path (P2) that is identical to the first arcuate path (P1) of the stator 12. The second plurality of pin holes 34 are angularly spaced apart from each other differently than an angular spacing of the first plurality of pin holes 20. For example, the first plurality of pin holes are spaced apart by 5.0° and the second plurality of pin holes are spaced apart by 5.2°. Other spacings could be selected depending on the particular application and tolerances.

A sealing cover 36 (most clearly shown in FIG. 6) engages against a second axial end face 15 of the stator 12. The sealing cover 36 includes at least one and preferably a plurality of third bolt holes 38. At least one bolt 40 extends through the at least one first bolt hole 18 of the stator, the at least one second bolt hole 32 of the locking cover 28, and the at least one third bolt hole 38 of the sealing cover 36.

Figure 6:
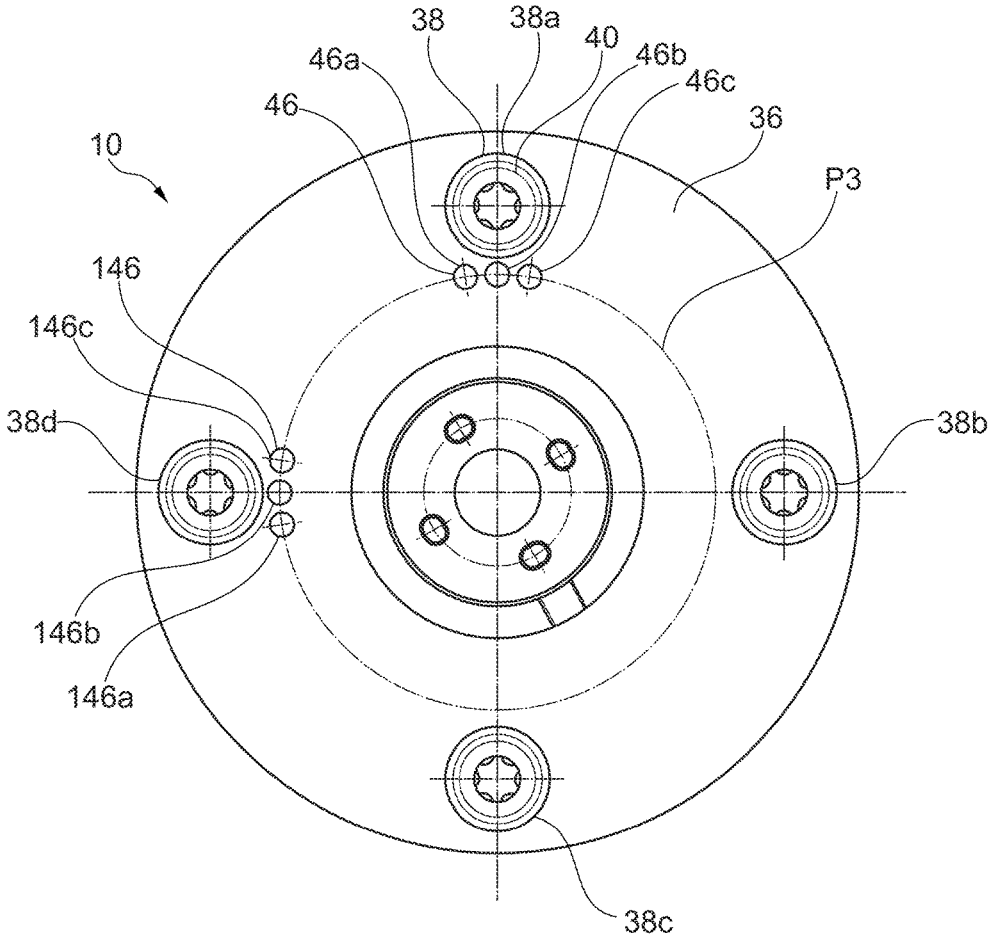
FIG. 6 is a front view of a sealing cover for the camshaft phaser of FIGS. 1-3.

As shown in FIG. 6, in another embodiment, the sealing cover 36 includes a third plurality of pin holes 46 arranged along a third arcuate path (P3) that is identical to the first arcuate path (P1) and the second arcuate path (P2). The pin 42 can engage within the third plurality of pin holes 46 of the sealing cover 36 by either a clearance fit or interference fit. The first plurality of pin holes 20, the second plurality of pin holes 34, and the third plurality of pin holes 46 each preferably consist of three pin holes, which are illustrated as holes 20*a*-20*c*, 34*a*-34*c*, and 46*a*-46*c* in FIGS. 4-6. Each of the first plurality of pin holes 20*a*-20*c*, each of the second plurality of pin holes 34*a*-34*c*, and each of the third plurality of pin holes 46*a*-46*c* are arranged along a same arc segment, i.e. the pin holes are all arranged at an identical radial distance from a central axis (X).

Figure 7B:
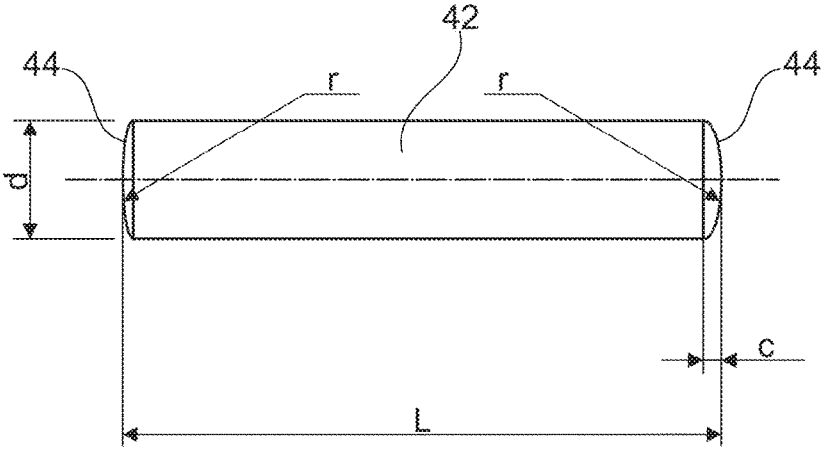
FIGS. 7A and 7B are a perspective view and a side view, respectively, of a locking pin for the camshaft phaser of FIGS. 1-3.
Figure 7A:
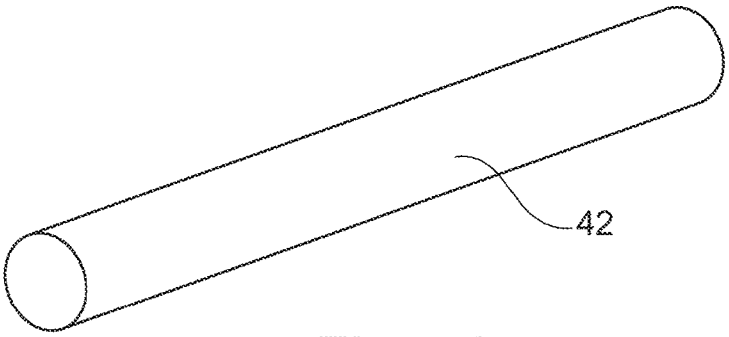

A pin 42 is also provided, as illustrated in FIGS. 7A and 7B. In an assembled stated, the pin 42, extends through a respective one of the first plurality of pin holes 20 and one of the second plurality of pin holes 34, and preferably also extends through one of the third plurality of pin holes 46, such that a location of the pin 42 is used for an angular adjustment of the locking pin bore 30 relative to the stator 12. The pin 42 can be manually inserted during assembly of the camshaft phaser. The pin 42 is used to "clock" or manually set a locking clearance with respect to the locking cover 28 with respect to the stator 12. Adjustment of the locking clearance is necessary due to manufacturing tolerances. For example, inserting the pin 42 into the central pin holes 34*b*, 20*b*, sets a nominal position of the locking cover relative to the stator 12. Using the pin holes 34*a*, 20*a* would result in a 0.5 degree shift counter clockwise, while using the pin holes 34*c*, 20*c* would result in a 0.5 degree shift clockwise. Insertion of the pin 42 within a respective one of the pin holes 20, 34 allows the locking clearance to be controlled by the location of the pin 42, instead of solely relying on the bolt 40 which is used in known camshaft phase adjustment assemblies. Because the pin 42 is responsible for setting the locking clearance, a cheaper, lower strength bolt 40 (compared to known assemblies) can be used since the load on the bolt 40 is reduced. The pin 40 also eliminates noise issues caused by imprecise locking pin clearance which was not previously adjusted for.

In one embodiment, the pin 42 has a clearance fit with the respective holes in the locking cover 28 and the sealing cover 36 and an interference fit with the holes of the stator 12. In another embodiment, the pin 42 has a clearance fit with the respective holes of the stator 12 and the sealing cover 36, and an interference fit with the holes of the locking cover 28. In another embodiment, the pin 42 has a clearance fit with the holes of the stator 12, and an interference fit with the respective holes of the locking cover 28 and the sealing cover 36. One of ordinary skill in the art would recognize from the present application that a clearance or interference fit could be used for arranging the pin 42 within any one or more of the holes of the stator 12, the locking cover 28, and the sealing cover 36.

The first plurality of pin holes 20*a*-20*c* are arranged along the first arcuate path (P1) and are angularly offset from each other by a first angular distance, the second plurality of pin holes 34*a*-34*c* are arranged along the second arcuate path (P2) and are angularly offset from each other by a second angular distance, and the third plurality of pin holes 46*a*-46*c* are arranged along the third arcuate path (P3) and are angularly offset from each other by a third angular distance. The first angular distance is preferably different than the second angular distance.

In one embodiment, the pin 42 is fixed within the respective one of the first plurality of pin holes 20 and the respective one of the second plurality of pin holes 34 by an interference fit. The pin 42 preferably includes rounded axial ends 44. The dimensions of the pin 42 depend on a specific application's requirements. A range of exemplary values for the dimensions are: a length (L) between 2 mm to 200 mm; a diameter (d) between 0.8 mm to 50 mm; a radius of curvature (r) between 0.8 mm to 50 mm; and an axial dimension (C) between 0.12 mm to 7.5 mm.

Figure 9:
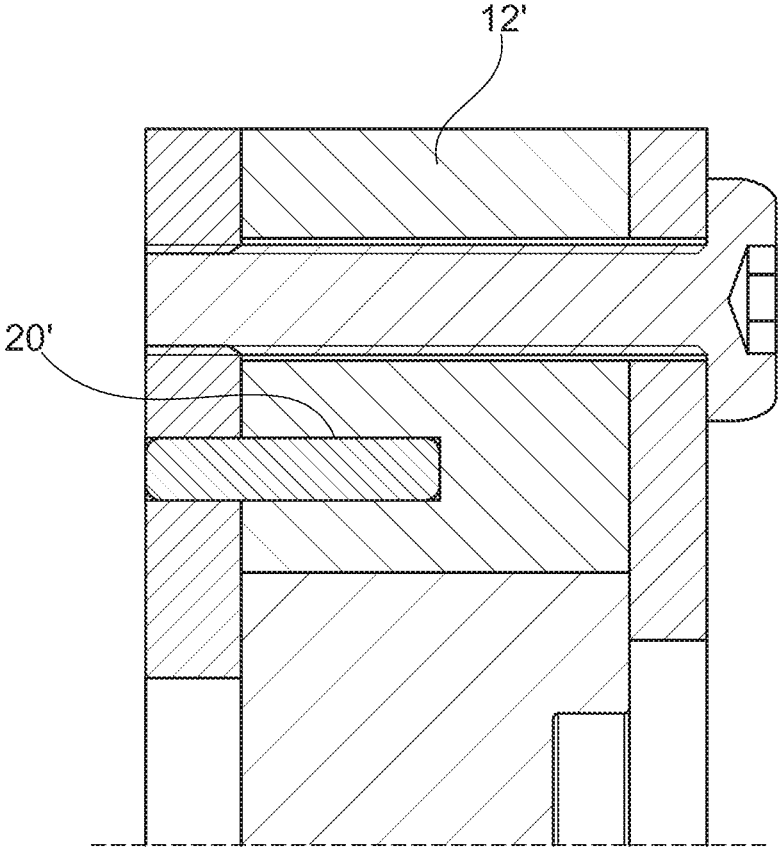
FIG. 9 is a magnified cross sectional view of the camshaft phaser with a stator according to a second embodiment.
Figure 10:
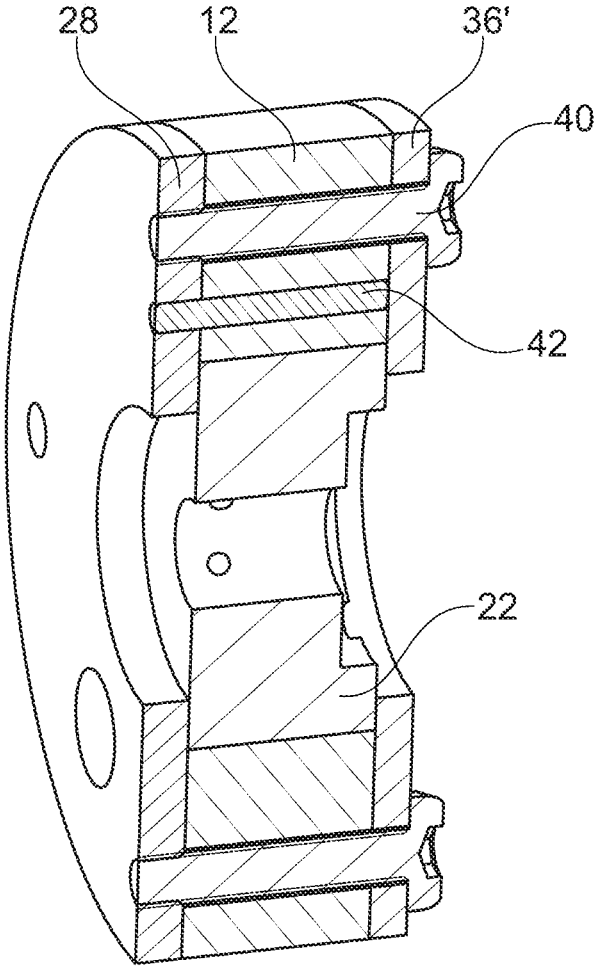
FIG. 10 is a perspective view of a cross section of the camshaft phaser with a sealing cover according to a second embodiment.

In the embodiment shown in FIGS. 9 and 10, the sealing cover 36' lacks pin holes. This embodiment is more cost-effective because pin holes are only required in the stator 12 and the locking cover 28.

In another embodiment, the first angular distance is different than the second angular distance and the third angular distance, and the second angular distance and the third angular distance are identical to each other. In one embodiment, the first angular distance is 5.2° between each pin hole, and the second angular distance is 5.0° between each pin hole. These angular distances will vary depending on a specific application's requirements.

Figure 4:
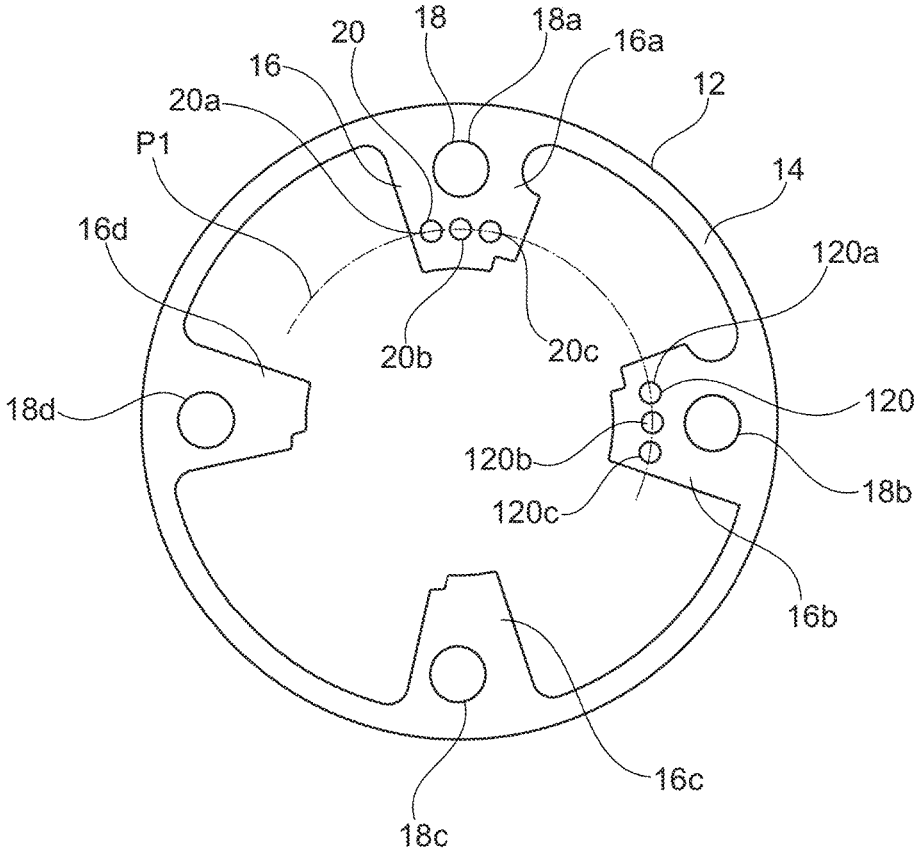
FIG. 4 is a front view of a stator for the camshaft phaser of FIGS. 1-3.
Figure 11:
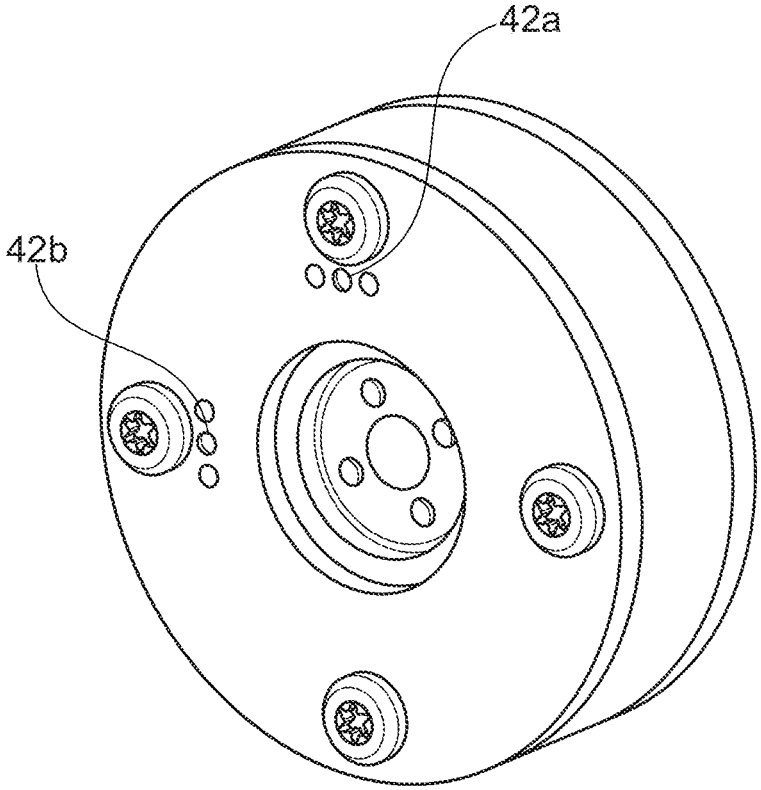
FIG. 11 is a perspective view of the camshaft phaser of FIGS. 1-3 including two sets of adjustment pin holes and two pins.

As shown in FIG. 4, there are preferably two first sets of first plurality of pin holes 20, 120, each of the two first sets of the first plurality of pin holes 20, 120 is located in a different one of the lobes 16. As shown in FIGS. 5 and 6, there are two second sets of the second plurality of pin holes 34, 134, and there are two third sets of the third plurality of pin holes 46, 146. FIGS. 4-6 illustrate each of the additional sets of the pin holes 120*a*-120*c*, 134*a*-134*c*, and 146*a*-146*c* consist of three pin holes. As shown in FIG. 11, two of the pins 42*a*, 42*b* are provided, and each one of the two pins 42*a*, 42*b* is arranged in a respective pin hole of each of the first sets of the first plurality of pin holes 20, 120, in a respective pin hole of each of the second sets of the second plurality of pin holes 34, 134, and in a respective pin hole of each of the third set of the third plurality of pin holes 46, 146.

FIGS. 6 and 11 show the at least one bolt 40 includes four bolts and the at least one first bolt hole 18 includes four first bolt holes 18*a*-18*d*. Each one of the four first bolt holes 18*a*-18*d* are arranged on a respective one of the radially inwardly extending lobes 16*a*-16*d*. In this embodiment, the at least one second bolt hole 32 also includes four second bolt holes 32*a*-32*d*, and the at least one third bolt hole 38 also includes four third bolt holes 38*a*-38*d*. Each one of the four bolts 40*a*-40*d* is arranged within a respective one of the four first bolt holes 18*a*-18*d*, a respective one of the four second bolt holes 32*a*-32*d*, and a respective one of the four third bolt holes 38*a*-38*d*.

Figure 8A:
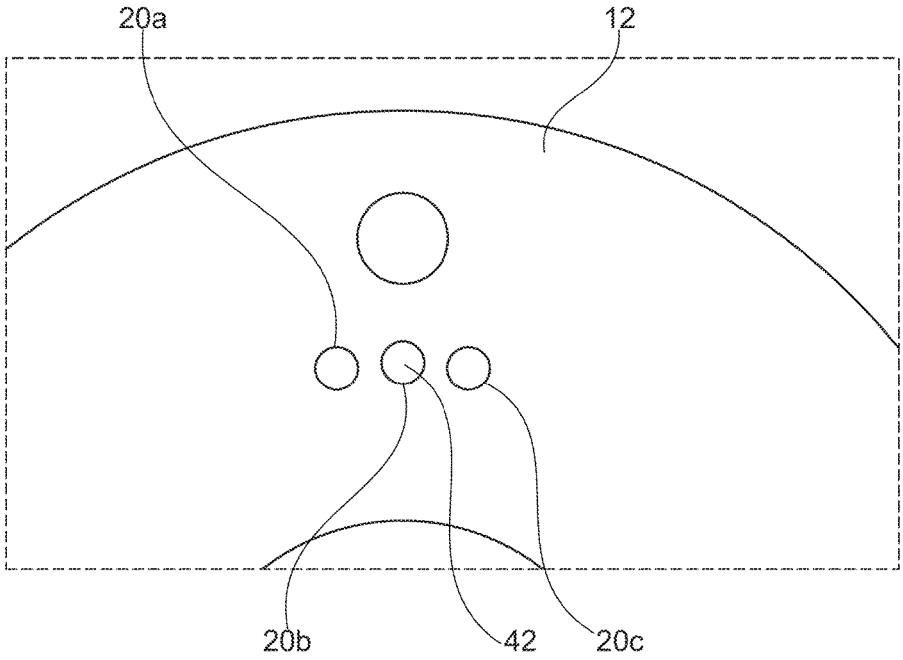
FIGS. 8A-8C illustrate the locking pin of FIGS. 7A and 7B in a specific pin hole of the camshaft phaser.
Figure 8B:
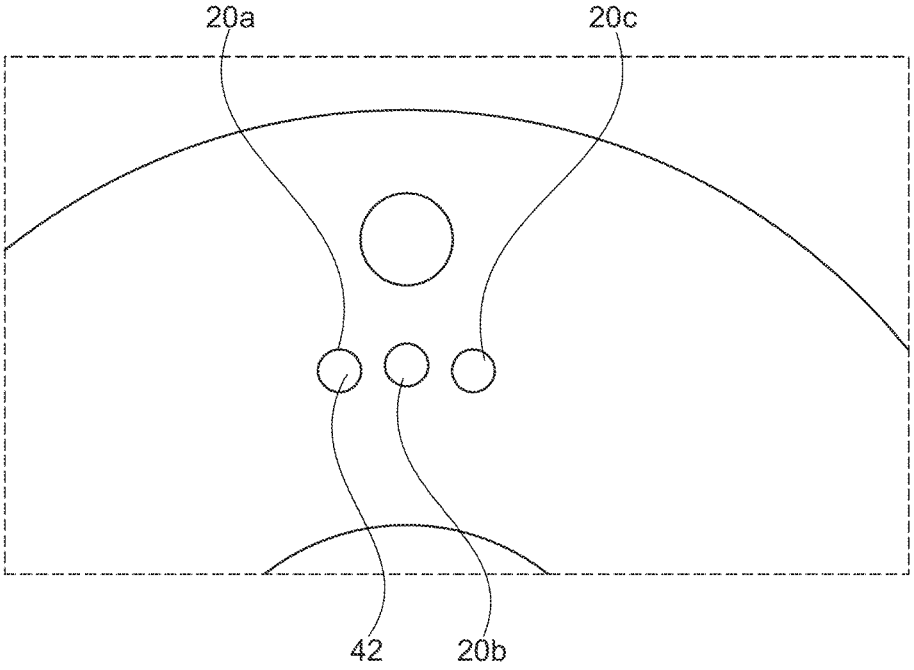
Figure 8C:
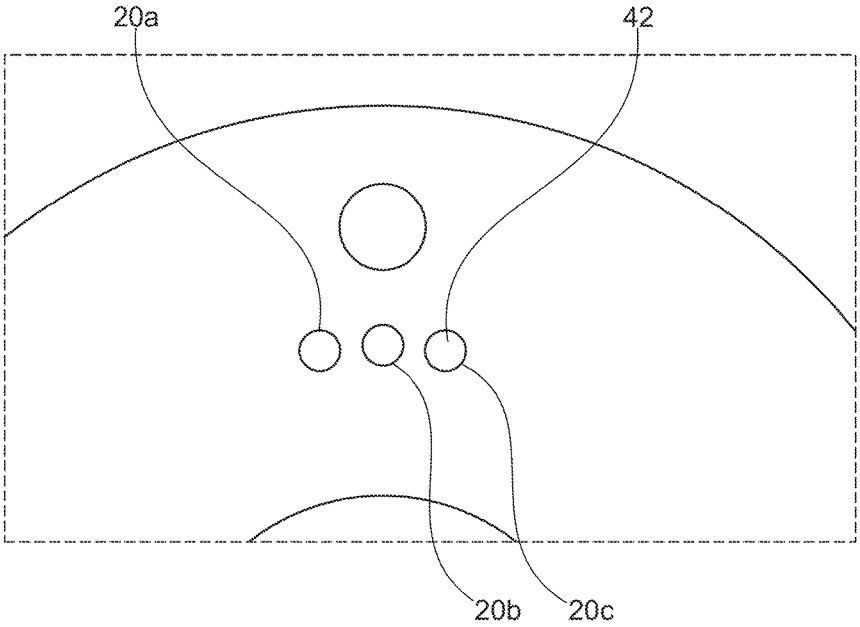

FIGS. 8A-8C illustrate the pin 42 positioned in a selected one of the first plurality of pin holes 20*a*-20*c* of the stator 12. Although not specifically illustrated in these Figures, one of ordinary skill in the art recognizes that the pin 42 would similarly be positioned in a respective pin hole of the second plurality of pin holes 34 of the locking cover 28 and the third plurality of pin holes 46 of the sealing cover 36. As shown in FIG. 8A, the pin 42 is positioned in a second or medial pin hole 20*b* of the first plurality of pin holes 20*a*-20*c* that corresponds to a mean locking clearance setting. In FIG. 8B, the pin 42 is positioned in a first pin hole 20*a* of the first plurality of pin holes 20*a*-20*c* that corresponds to a minimum locking clearance setting. In FIG. 8C, the pin 42 is positioned in a third pin hole 20*c* of the first plurality of pin holes 20*a*-20*c* that corresponds to a maximum locking clearance setting. In one embodiment, the pin holes 20*a*-20*c* correspond to a minimum locking clearance setting, a mean locking clearance setting, and a maximum locking clearance setting, respectively. One of ordinary skill in the art will recognize from the present application that any number pin holes could be provided to provide additional options for setting a locking clearance.

Having thus described the present invention in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

LIST OF REFERENCE NUMERALS camshaft phaser 10
stator 12
first axial end face 13
outer circumferential wall 14
second axial end face 15
radially inwardly extending lobes 16
first bolt hole 18*a*-18*d*
first plurality of pin holes 20*a*-20*c*, 120*a*-120*c*, 20'
rotor 22
locking cover 28
locking pin bore 30
second bolt hole 32
second plurality of pin holes 34*a*-34*c*, 134*a*-134*c*
sealing cover 36
third bolt hole 38
bolt 40
pin 42, 42*a*, 42*b*
rounded axial ends 44
third plurality of pin holes 46*a*-46*c*, 146*a*-146*c*
locking assembly 60

What is claimed is:

1. A camshaft phaser comprising:

a stator including an outer circumferential wall with radially inwardly extending lobes circumferentially spaced apart from each other, at least one first bolt hole extending axially through at least one of the radially inwardly extending lobes, and a first plurality of pin holes extending axially in at least one of the radially inwardly extending lobes arranged along an arcuate path;

a rotor arranged within the stator including radially outwardly extending vanes, each of the vanes being arranged between an adjacent pair of the radially inwardly extending lobes of the stator to define an advance chamber and a retard chamber on opposite sides of each of the vanes between the stator and the rotor;

a locking cover engaged against a first axial end face of the stator, the locking cover including a locking pin bore, at least one second bolt hole, and a second plurality of pin holes arranged along the arcuate path and spaced apart from one another by a different angular spacing than the first plurality of pin holes;

a sealing cover engaged against a second axial end face of the stator, the sealing cover including at least one third bolt hole;

at least one bolt extending through the at least one first bolt hole of the stator, the at least one second bolt hole of the locking cover, and the at least one third bolt hole of the sealing cover; and a pin extending through a respective one of the first plurality of pin holes and one of the second plurality of pin holes, such that a location of the pin sets an angular adjustment of the locking pin bore relative to the stator.

2. The camshaft phaser of claim 1, wherein the pin includes rounded axial ends.

3. The camshaft phaser of claim 1, wherein the first plurality of pin holes are blind holes.

4. The camshaft phaser of claim 1, wherein the first plurality of pin holes extend between the first and second axial end faces of the stator.

5. The camshaft phaser of claim 1, wherein the at least one bolt includes four bolts, the at least one first bolt hole includes four first bolt holes, each one of the four first bolt holes are arranged on a respective one of the radially inwardly extending lobes, the at least one second bolt hole includes four second bolt holes, the at least one third bolt hole includes four third bolt holes, and each one of the four bolts is arranged within a respective one of the four first bolt holes, a respective one of the four second bolt holes, and a respective one of the four third bolt holes.

6. The camshaft phaser of claim 1, wherein the pin is fixed within the respective one of the first plurality of pin holes and the respective one of the second plurality of pin holes by an interference fit.

7. The camshaft phaser of claim 1, wherein the sealing cover further comprises a third plurality of pin holes arranged along the arcuate path.

8. The camshaft phaser of claim 7, wherein each of the first plurality of pin holes are spaced apart from each other by a first angular distance, and each of the second plurality of pin holes and each of the third plurality of pin holes are spaced apart from each other by a second angular distance that is different than the first angular distance.

9. The camshaft phaser of claim 7, wherein the first plurality of pin holes, the second plurality of pin holes, and the third plurality of pin holes each consist of three pin holes.

10. The camshaft phaser of claim 7, wherein there are two first sets of first plurality of pin holes, each of the two first sets of the first plurality of pin holes is located in a different one of the lobes, there are two second sets of the second plurality of pin holes, and there are two third sets of the third plurality of pin holes.

11. The camshaft phaser of claim 10, wherein two of the pins are provided, and each one of the two pins is arranged in a respective pin hole of each of the two first sets of the first pair of the first plurality of pin holes, in a respective pin hole of each of the two second sets of the second plurality of pin holes, and in a respective pin hole of each of the two third sets of the third plurality of pin holes.

12. A method for setting a locking clearance of a camshaft phaser, the method comprising:

providing a stator including an outer circumferential wall with radially inwardly extending lobes circumferentially spaced apart from each other, at least one first bolt hole extending axially through at least one of the radially inwardly extending lobes, and a first plurality of pin holes extending axially in at least one of the radially inwardly extending lobes arranged along an arcuate path; a rotor arranged within the stator including radially outwardly extending vanes, each of the vanes being arranged between an adjacent pair of the radially inwardly extending lobes of the stator to define an advance chamber and a retard chamber on opposite sides of each of the vanes between the stator and the rotor; a locking cover engaged against a first axial end face of the stator, the locking cover including a locking pin bore, at least one second bolt hole, and a second plurality of pin holes arranged along the arcuate path and angularly spaced apart from one another by a different angular spacing than the first plurality of pin holes; a sealing cover engaged against a second axial end face of the stator, the sealing cover including at least one third bolt hole; at least one bolt extending through the at least one first bolt hole of the stator, the at least one second bolt hole of the locking cover, and the at least one third bolt hole of the sealing cover; and a pin;

inserting the pin through a respective one of the first plurality of pin holes and one of the second plurality of pin holes; and setting an angular adjustment of the locking pin bore relative to the stator by positioning the pin within the respective one of the first plurality of pin holes and one of the second plurality of pin holes.

* * * * *